United States Patent [19]

Winnemöller

[11] Patent Number: 4,691,603

[45] Date of Patent: Sep. 8, 1987

[54] CUTTING APPARATUS FOR CUTTING SHEET MATERIAL

[75] Inventor: Aloys Winnemöller, Rheine, Fed. Rep. of Germany

[73] Assignee: Windmöller & Hölscher, Lengerich, Fed. Rep. of Germany

[21] Appl. No.: 824,119

[22] Filed: Jan. 30, 1986

[30] Foreign Application Priority Data

Jan. 30, 1985 [DE] Fed. Rep. of Germany ..... 3503094

[51] Int. Cl.[4] ..... B26D 7/06

[52] U.S. Cl. ..... 83/151; 83/103; 83/161; 83/343

[58] Field of Search ..... 83/151, 152, 161, 156, 83/302, 337, 343–348, 423, 647.5

[56] References Cited

U.S. PATENT DOCUMENTS

| | | | |
|---|---|---|---|
| 1,989,012 | 1/1935 | Kalko | 83/328 |
| 2,318,953 | 5/1943 | Meyer | 83/161 X |
| 3,949,653 | 4/1976 | Schroter | 83/103 |

FOREIGN PATENT DOCUMENTS

| | | |
|---|---|---|
| 716250 | 1/1942 | Fed. Rep. of Germany . |
| 1105698 | 4/1961 | Fed. Rep. of Germany . |
| 1923211 | 9/1965 | Fed. Rep. of Germany . |
| 722123 | 1/1955 | United Kingdom . |

*Primary Examiner*—E. R. Kazenske
*Assistant Examiner*—Scott A. Smith
*Attorney, Agent, or Firm*—Fleit, Jacobson, Cohn & Price

[57] ABSTRACT

Cutting apparatus for cutting moving sheets or webs. A rotatable cutter carrier and a rotatable backup member are respectively provided with cutter blades and grooves, which cooperate in the plane of the sheet and are moved by planetary gear trains through cutting positions wherein cutter blades and backup bars are moved into face-to-face relationship to effect cuts in sheet material that passes therebetween. The gear trains include a stationary sun gear, and idler gears that are rotatably carried in carrier discs and that mesh with the sun gear and with planet gears that are non-rotatably connected to respective ones of cutter bars that carry the cutter blades and to cooperating backup bars. One of the cutter bars or the backup bars is provided with extensible needles for piercing a portion of the sheet section that is intended to be removed therefrom. Holders for the needles are provided with cam followers that engage with a rotatable cam to cause the needles to be extended and to engage the sheet section intended to be removed.

6 Claims, 4 Drawing Figures

II
II
1
2
3
4
5
5a
6
6a
7
8
9
9a
10
10a
11
11a
11b
12
13
13a
14
15
15a
16
17
18
19
20
21
22
23
24
25
26
27
28
29
30
31
38
39
43
44
45
46
47
48
49
51
52
53
54
55
56
58

CUTTING APPARATUS FOR CUTTING SHEET MATERIAL

BACKGROUND OF THE INVENTION

1. Field of the Invention

This invention relates to cutting apparatus for cutting sheet materials, and more particularly to a rotatable cutter and a rotatable backup member for providing cuts that define a removable portion of the sheet, and means for removing the removable portion therefrom.

2. Description of the Prior Art

Rotary cutting apparatus is known from German Patent Publication No. 11 05 698. That known cutting apparatus can be used to make straight and stepped cuts in alternation in a continuously traveling tubular film so that tubular sections are cut from the film. The stepped cuts usually result in cut-out web sections, which must be removed from the apparatus in order to avoid disturbances. However, no means for removing such cut-out web sections are disclosed in that publication.

German Patent Specification No. 716,250 describes a cutting apparatus which includes cutter blades that are rigidly coupled to a shaft and spaced 180° apart and serve to make straight and stepped cuts. The cutter blades cooperate in alternation with a grooved bar, which rotates at twice the speed of the cutter blades but at the same peripheral velocity. In that known apparatus a two-armed lever is pivoted to a rotating lever which carries the grooved bar, and one arm of the two-armed lever carries a needle for piercing the cut-out web sections whereas the other arm carries a cam follower roller, which rolls on a cam wheel. The extending and retracting motion of the needle is controlled by an eccentric segment, which is pivotally movable out of and into the orbit of the cam follower roller and is controlled by means of laterally disposed linkages and two-armed levers by an eccentric which is non-rotatably connected to the cutter shaft.

The cutting apparatus known from German Patent Publication No. 11 05 698 cannot be provided with the apparatus which is known from German Patent Specification No. 716,250 and that serves to remove cut-out web sections. This is due to the fact that because of the physical arrangement of the elements disclosed in German Patent Publication No. 11 05 698, involving the locations of the rotating grooved bars and cutter bars, and of the gears for moving the bars parallel to each other, there is no space available for accommodating such mechanism.

SUMMARY OF THE INVENTION

Briefly stated, in accordance with one aspect of the present invention, a cutting apparatus for cutting sheet materials is provided, the cutting apparatus including rotatable cutter means and rotatable cutter backup means, one of which includes retractable needle means to remove cut-out section from the sheet. The rotatable cutter means carries a sheet material cutter member, and a rotatable cutter backup member is provided and is cooperable with the cutter member for effecting cutting of sheet material that passes between the cutter means and the cutter backup means, the cuts serving to define a removable waste sheet portion. Retractable needle means are carried by one of the cutter means and the cutter backup means for piercing the removable waste sheet portion to effect removal of that portion from the sheet material after the desired cuts have been made in the material. The needle means includes a needle holder supported for movement along the longitudinal axis of the needle and the needle holder has a cam follower engageable with a rotatable cam, the cam carried by the one of the cutter means and cutter backup means that carries the retractable needle means. The cam and cam follower serve to move the needle means into piercing engagement with the waste sheet portion at the proper time in the operating cycle, and to remove the waste sheet portion from the sheet material.

DESCRIPTION OF THE PREFERRED EMBODIMENT

Figure 1:
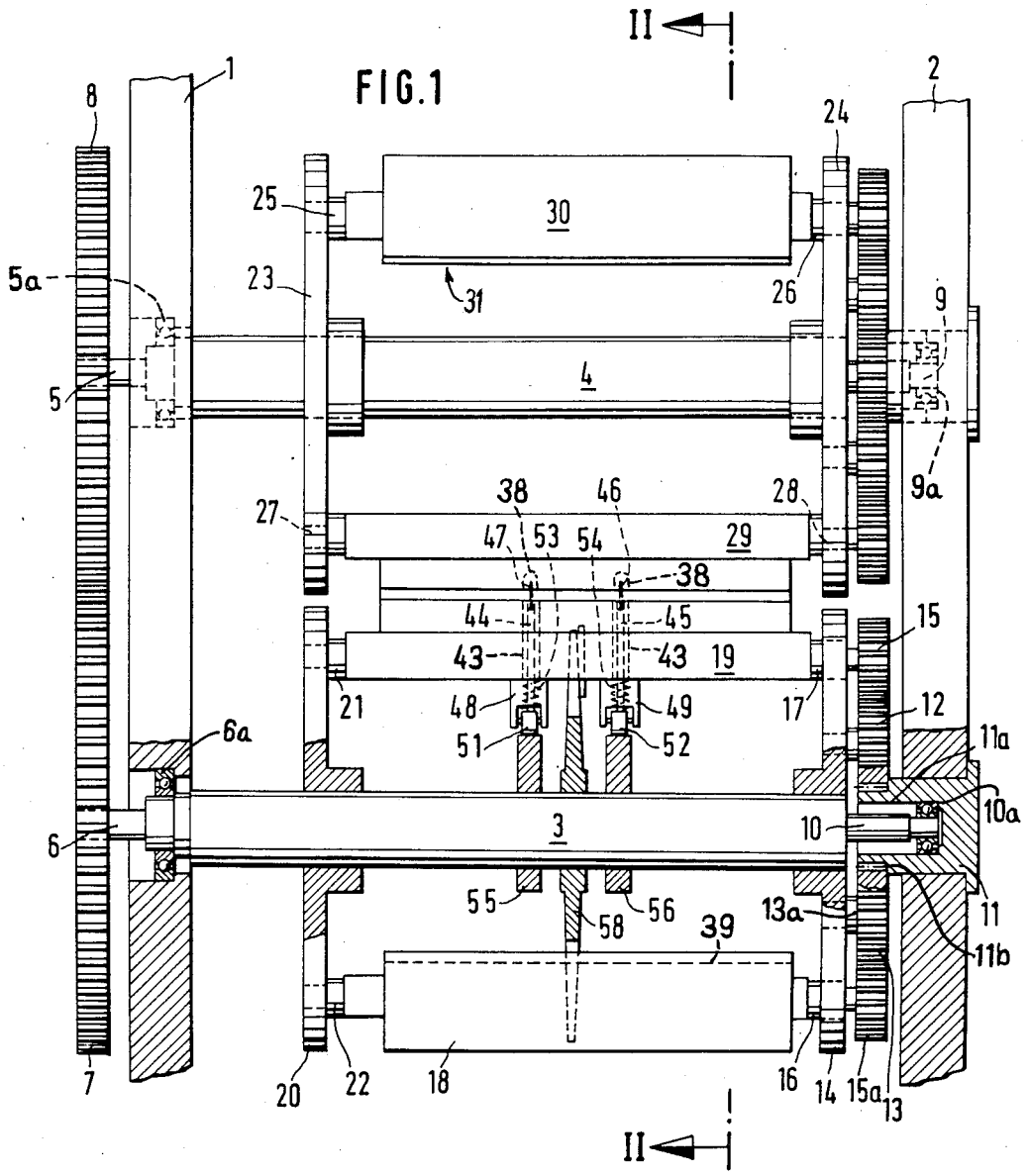
FIG. 1 is a fragmentary front elevation, partially in section, showing cutting apparatus in accordance with the present invention and including apparatus for removing removable sections that have been defined by cuts formed in sheet material.

Referring now to the drawings, and particularly to FIG. 1 thereof, there is shown a cutting apparatus that includes a frame having a pair of spaced, substantially parallel side walls 1, 2, between which shafts 3 and 4 are rotatably supported in bearings 6*a*, 10*a*, and 5*a*, 9*a*, respectively. Shaft 3 includes at one end thereof an outwardly extending shaft end portion 6, that carries a drive gear 7 that is keyed thereto for rotation therewith. Similarly, shaft 4 includes at a corresponding end thereof a shaft end portion 5 that carries a drive gear 8 that is keyed thereto for rotation therewith. Each of drive gears 7 and 8 are in meshing engagement and are of the same pitch diameter and have the same number of teeth so that shafts 3 and 4 rotate in opposite directions, but at the same rotational speed. Suitable drive means (not shown) can be provided to drive one or the other of drive gears 7 and 8 in order to cause shafts 3 and 4 to rotate.

At the opposite end of shaft 3 from which shaft end portion 6 extends, outwardly extending shaft end portion 10 is provided and is received in an opening defined by an annular flange 11*a* that forms a part of a bushing 11 that is non rotatably received in side wall 2 and houses bearing 10*a*.

Shaft 3 also carries a pair of axially spaced carrier discs 14, 20, that are suitably connected with shaft 3 to rotate therewith. Carrier disc 14 includes a pair of stub shafts 12*a* and 13*a* that are non-rotatably secured thereto and are positioned radially outwardly from and on opposite sides of the axis of shaft 3. Each of stub shafts 12*a* and 13*a* rotatably carries an idler gear 12, 13, respectively. Carrier disc 14 also rotatably carries stub shafts 16 and 17, that extend therethrough in a direction parallel to the axis of shaft 3 and are spaced radially outwardly of stub shafts 13*a*, 12*a*, respectively. The outer ends of stub shafts 16, 17 have secured thereto planet gears 15*a* and 15, respectively, which are diametrically opposed and spaced outwardly from and are in meshing engagement with idler gears 13 and 12, respectively. A stationary sun gear 11*b* is defined by external teeth that are formed on the innermost portion of the outer surface of annular flange 11*a*. Thus, gear teeth 11*b*, together with idler gears 12 and 13, and planet gears 15 and 15*a*, define a planetary gear train that rotates each of stub shafts 16 and 17 at an angular speed that is related to the angular speed of shaft 3.

Figure 2:
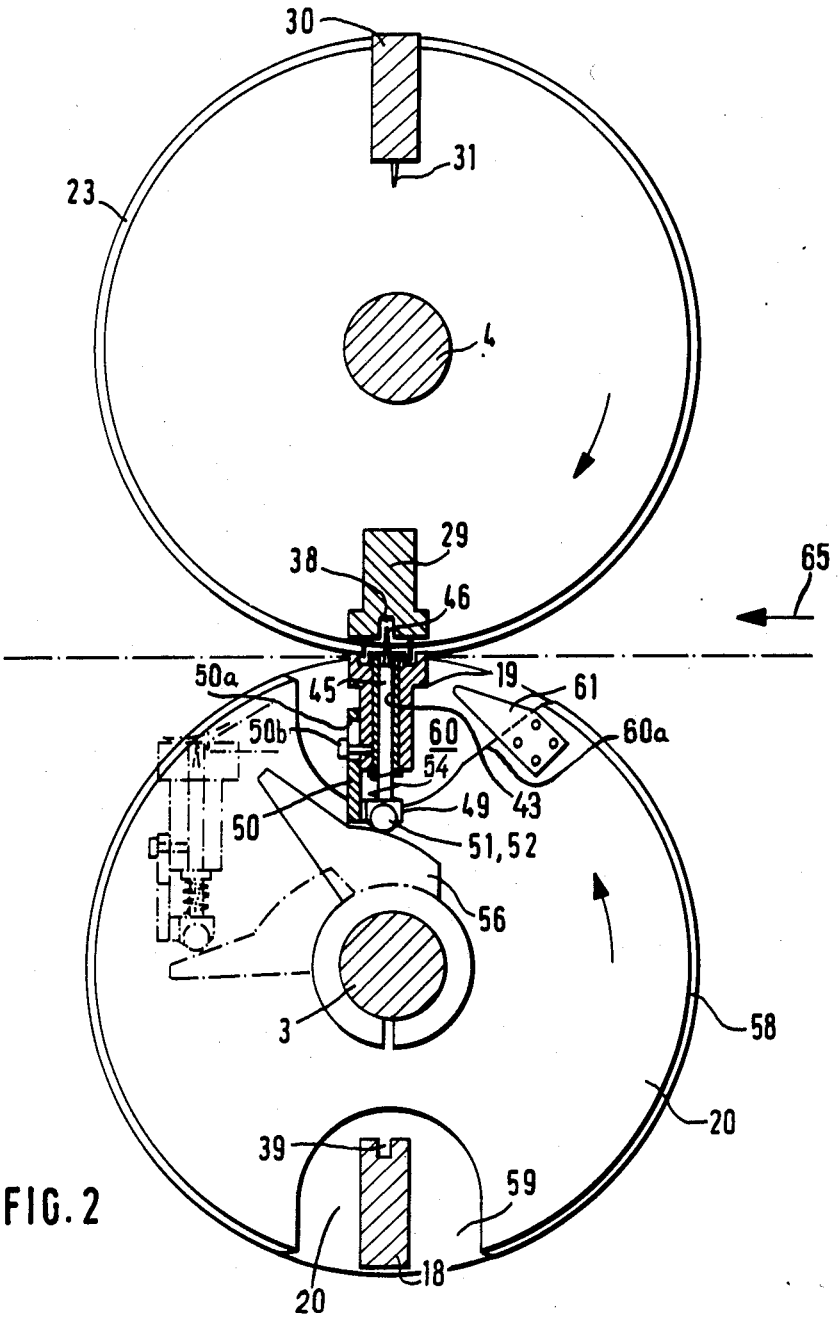
FIG. 2 is a cross-sectional elevational view taken along the line 2—2 of FIG. 1.

Secured to the innermost end of stub shaft 16 is backup bar 18, which is of generally rectangular configuration (see FIGS. 1 and 2), and from the opposite end of which stub shaft 22 extends and is rotatably received in carrier disc 20. Consequently, backup bar 18 is rotatably carried between carrier discs 14 and 20, about the axis of rotation defined by stub shafts 16 and 22, the speed of rotation being dependent upon the gear ratios in the planetary gear train, and the rotational speed of shaft 3. As best seen in FIG. 2, backup bar 18 includes a longitudinally extending groove 39 that is formed in one outer face of backup bar 18, and that extends in the direction of the axis of rotation thereof. Similarly, a second backup bar 19 is secured to the innermost end of stub shaft 17, and at the opposite end of backup bar 19 a stub shaft 21 is secured thereto and is rotatably received in carrier disc 20. As was the case in connection with backup bar 18, backup bar 19 is also rotatable, the rotation taking place about the axis of rotation defined by stub shafts 17 and 21.

Shaft 4 carries a similar structure to that of shaft 3 in that it includes two axially spaced carrier discs 23, 24, having substantially the same axial spacing as that of carrier discs 14, 20 and a similar planetary gear train carried by carrier disc 24. Stub shafts 25 and 26 rotatably support a cutter bar 30, that includes a straight cutter blade 31 that is spaced from and parallel to the axis of rotation of cutter bar 30 defined by stub shafts 25 and 26. Cutter blade 31 includes a cutting edge and is adapted to cooperate with groove 39 in backup bar 18 and to extend thereinto to effect a cutting operation in a sheet of material, as will hereinafter be more fully described. Additionally, a stub shaft 27 is rotatably carried in carrier disc 23, and a stub shaft 28 is rotatably carried in carrier disc 24, and a cutter bar 29 extends between stub shafts 27 and 28 and is secured thereto to rotate therewith. Cutter bar 29 includes one or more cutter blades that are so positioned to define the perimeter of a closed area that constitutes a removable portion of a sheet. Further, cutter bar 29 is adapted to be cooperable with backup bar 19, and the latter has grooves on one surface to correspond with the perimeter of the removable portion of the sheet.

Figure 4:
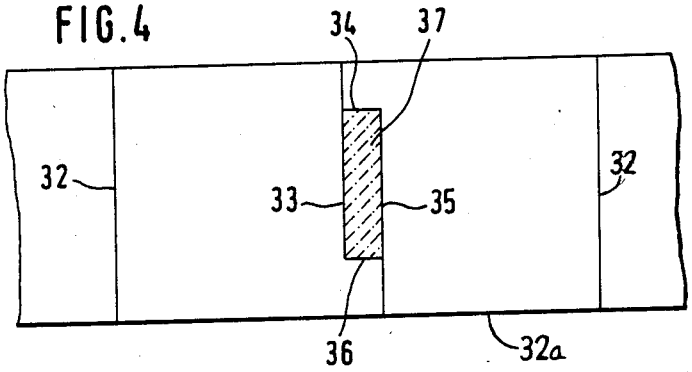
FIG. 4 shows a fragment of a web of material that has been cut by transverse cuts and by longitudinal cuts, several of the cuts defining an area intended to be severed and removed from the web.

FIG. 4 illustrates several types of cuts that can be effected by cutting apparatus according to the present invention. As therein shown, a continuous web 32*a* includes spaced, transversely extending linear cuts 32 that can be provided by cooperative action between cutter bar 30 and backup bar 18, and it also includes intermediate cut sections defined by transverse linear cuts 33 and 35 that extend only partially across web 32*a*, and laterally spaced, longitudinally extending cuts 34 and 36, the cuts 33, 34, 35, 36 defining the perimeter of a piece of waste 37 that is intended to be removed upon completion of the cutting operation. The latter cuts can be provided by cooperative action between cutter bar 29 and backup bar 19. Additionally, although described herein as a plurality of linear cuts, waste portion 37 can also be defined by one or more curved cuts, or a combination of curved and straight cuts, if desired.

Figure 3:
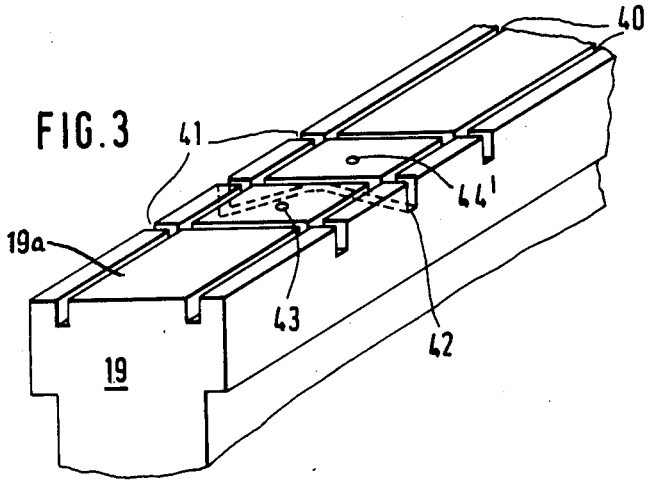
FIG. 3 is a perspective view showing a grooved cutter backup bar that is cooperable with a cutter blade for cutting sheet material.

The relative orientation of the cutter bar assembly and the backup bar assembly is illustrated in FIG. 2, which also shows the interengagement of the cutters on cutter bar 29 with corresponding grooves formed in backup bar 19. As more clearly seen in FIG. 3, backup bar 19 has a top surface 19*a* that includes a pair of spaced, parallel linear grooves 40 that extend longitudinally of the bar, and a pair of spaced, parallel, linear transverse grooves 41, with an intermediate transverse groove 42 positioned between respective transverse grooves 41. Each of grooves 41 and 42 has a predetermined depth to receive a correspondingly shaped cutter blade without the blade contacting the bottom of the groove. Each of grooves 41 extends in a direction perpendicular to the longitudinal axis of backup bar 19 and in the direction of rotation of carrier discs 14 and 20. The respective grooves in backup bar 19 permit the formation of the plural cuts illustrated in FIG. 4 with respect to the piece of waste 37. Correspondingly positioned straight cutting blades are carried in cutter bar 29, the cutter blades being aligned with and received within the respective grooves in backup bar 19 to effect a cutting operation when a sheet of material is interposed between cutter bar 29 and backup bar 19, as will be described hereinafter in connection with the operation of the apparatus. Further, backup bar 19 includes a pair of spaced through-bores 43 that are positioned between transverse grooves 41.

As best seen in FIGS. 1 and 2, backup bar 19, which includes the grooves that define the perimeter of waste portion 37, carries a pair of axially spaced needle holders 44 and 45, which are slidably carried in the through bores 43 formed in backup bar 19. The needle holders each carry an outwardly extending, serrated needle, 46, 47, respectively, that is adapted to be received within respective, oppositely positioned blind bores 38 formed in the cooperating outer surface of cutter bar 29. The serrations on needles 46, 47, are for providing frictional gripping engagement with the material into which the needles are projected. The ends of needle holders 44, 45 opposite from the ends from which needles 46, 47 extend each include a yoke 48, 49, respectively, that carries a roller 51, 52, respectively, and is biased in a downward, or retracted direction as viewed in FIGS. 1 and 2, toward the axis of rotation of shaft 3, by means of compression springs 53, 54, respectively. Each of yokes 48, 49 includes a guide rib 50 that is secured thereto and extends along and is in slidable engagement with the outer side surface of backup bar 19. Guide ribs 50 each include an elongated slot 50*a* that extends in the direction of movement of the respective needle holder, and the backup bar 19 carries a guide pin 50*b* that extends through the respective slot 50*b* and terminates in a headed end to retain guide rib 50 against the side of backup bar 19 and to permit sliding movement of guide rib 50 relative to backup bar 19, along a maximum distance defined by the length of the slot. Yokes 48, 49, rotatably carry cam followers 51, 52, respectively, which are in contact with and roll along an edge surface of cam members 55, 56, respectively, that extend from and are secured to shaft 3 and rotate therewith. Cam members 55, 56, have an edge profile as best seen in FIG. 2, and cause axial movement of respective needle holders 44, 45 within backup bar 19 and toward and away from cutter bar 29 in timed relationship thereto.

As also seen in FIG. 2, an intermediate carrier disc 58 is secured to shaft 3 to rotate therewithin and is positioned between cam members 55 and 56. Carrier disc 58 includes diametrically opposed peripheral openings 59, 60, to receive and to permit rotation therewithin of backup bars 18, 19, respectively. Additionally, opening 60 includes an angular ramp 60*a* from which a scraper 61 extends into opening 60 and is adapted to be received in and to pass through transverse groove 42 in backup bar 19 as the latter rotates within opening 60.

In operation, a sheet or web of material to be cut is fed to the cutting apparatus in the direction of arrow 65 shown in FIG. 2 and respective shafts 3 and 4 are set into rotation. The feeding of the sheet or web is synchronized with the speed of rotation of shafts 3 and 4 so that the linear speed of the sheet or web corresponds substantially with the peripheral speed at the outermost surfaces of the cutter bars and their associated backup bars. As the shafts 3 and 4 rotate, the cutter bars and the backup bars also rotate and they come together as illustrated in FIG. 2 so that the cutter blades carried by the cutter bar extend into the corresponding grooves formed in the backup bar to provide the desired cuts in the sheet or web. As the cuts that define a waste area to be removed are being made, the needles carried by needle holders 44 and 45 are moved outwardly from the backup bar 19 by means of the cams 55 and 56 and pass into and pierce the waste area of the material, such as piece 37 illustrated in FIG. 4. By virtue of the serrations on the needles, the waste area is retained thereon, and the movement of backup bar 19 away from the sheet material as shaft 3 continues to rotate gulls the waste piece from the main eortion of the sheet or web to effect positive removal therefrom. As the shafts 3, 4, rotate further, the backup bar 19 travels in a counterclockwise direction, as viewed in FIG. 2, from the position illustrated in full lines to the position illustrated in dashed lines, and also rotates clockwise about its own axis of rotation, whereupon the needles and needle holders are retracted into the backup bar and the backup bar is tilted with respect to the periphery of the carrier disc 58, so that scraper 61 engages with and passes along transverse groove 42 of backup bar 19 to help to strip the piece of waste material 37 from the needles 46, 47. Although not shown, a suitable collection device can be provided to receive and carry away the respective waste portions 37 as they are removed from the needles.

In addition to placement of the needles in the backup bar, the needle holders and associated needle extending and retracting structure can also be carried in the cutter bar, if desired.

Although particular embodiments of the invention have been illustrated and described, it will be apparent to those skilled in the art that various changes and modifications can be made without departing from the spirit of the present invention. It is intended to encompass within the scope of the appended claims all such changes and modifications that fall within the scope of the present invention.

What is claimed is:

1. A cutting apparatus for cutting sheet materials, said apparatus comprising:

(a) cutter means for carrying a sheet material cutter member, said cutter means rotatable about a first axis and said cutter member rotatable about a second axis spaced from and parallel to said first axis;

(b) cutter backup means for carrying a backup member cooperable with said cutter member for effecting cutting of sheet material that is passed between said cutter member and said backup member to define a removable waste sheet portion, said cutter backup means rotatable about a third axis spaced from and parallel to said first axis, said backup member rotatable about a fourth axis spaced from and parallel to said third axis; and (c) retractable needle means carried by one of said cutter means and said cutter backup means for piercing said removable waste sheet portion to effect removal thereof from the sheet material after cutting, said needle means, including a needle and a needle holder therefor, supported for movement along the longitudinal axis of the needle and having a cam follower engageable with a rotatable cam carried by said one of said cutter means and said cutter backup means to move said needle means into piercing engagement with the waste sheet portion and remove the waste sheet portion from the sheet material.

2. A cutting apparatus according to claim 1, wherein said cutter member and said backup member are rotatably mounted in respective spaced, substantially parallel carrier discs that are rotatable about respective spaced, parallel axes, and said apparatus includes means for rotating said cutter member and said backup member relative to said respective carrier discs in predetermined angular relationship to effect cooperative engagement between said cutter member and said backup member to cut a sheet of material that is passed therebetween.

3. A cutting apparatus according to claim 1, wherein said backup member carries said retractable needle means and includes at least one bore for guiding said needle holder, said needle holder including a yoke that carries said cam follower, a guide rib carried by said needle holder for limited guiding movement along a surface of the backup member, and biasing means for urging said needle and needle holder into a retracted position relative to said backup member.

4. A cutting apparatus according to claim 3, wherein said guide rib includes a slot that extends in a direction parallel to the needle axis and that has a predetermined length to define the maximum needle displacement distance, and a guide pin carried on the backup member and extending through said slot to define a stop to limit the extent of movement of said guide rib relative to said backup member.

5. A cutting apparatus according to claim 1, wherein said rotatable cam includes an outwardly extending arm that includes a side cam face against which said cam follower moves.

6. A cutting apparatus according to claim 3, wherein said apparatus includes an intermediate carrier disc that includes diametrically opposed peripheral openings to receive a pair of backup members and having a size sufficient to permit rotation of the backup members therewith, said intermediate disc secured non-rotatably to a shaft that carries discs that rotatably support the backup members, one of the peripheral openings including a scraper that extends into said one opening, and wherein one of said backup members defines a peripheral groove extending in a direction of rotation of said rotatable cutter backup means, and said scraper is movable along said groove for separating said waste sheet portion from said backup member when said backup member is rotated relative to said intermediate carrier disc.

* * * * *